United States Patent [19]

Chun

[11] Patent Number: 4,471,709

[45] Date of Patent: Sep. 18, 1984

[54] PRETENSIONED CATENARY FREE DEEP SEA MOORING SYSTEM

[76] Inventor: Joong H. Chun, 4232 E. 84th St., Tulsa, Okla. 74136

[21] Appl. No.: 345,568

[22] Filed: Feb. 4, 1982

[51] Int. Cl.[3] ..... B63B 21/24

[52] U.S. Cl. ..... 114/293

[58] Field of Search ..... 114/230, 264, 293, 144 B; 441/3, 29

[56] References Cited

U.S. PATENT DOCUMENTS

| | | | |
|---|---|---|---|
| 2,791,979 | 5/1957 | Willis | 441/23 |
| 3,390,408 | 7/1968 | Lockwood, Jr. et al. | 441/3 |
| 4,176,986 | 12/1979 | Taft et al. | 441/29 |

FOREIGN PATENT DOCUMENTS

| | | | |
|---|---|---|---|
| 1230157 | 9/1960 | France | 114/293 |

*Primary Examiner*—Trygve M. Blix
*Assistant Examiner*—Jesûs D. Sotelo

[57] ABSTRACT

A pretensioned catenary free deep sea mooring system for marine vessels and structures incorporating a number of elongated rigid tension members and an automated sagging preventer. The tension members are secured in end-to-end relation by connecting links, thus forming an elongated articulated mooring chain that is capable of withstanding predetermined forces in tension. The tension members and the connecting links have a neutral buoyancy in water. The mooring chain is anchored at one extremity to a submerged anchor or pile and extends upwardly in angularly oriented relation to an automated sagging preventer which is connected to the marine vessel or structure. When placed in tension, the neutrally buoyant mooring chain extends in straight line manner from the anchoring point to the connection point at the vessel or structure without forming a catenary. Each mooring chain of the mooring system is pretensioned by means of a constant force application that allows restrained movement of the vessel or structure.

17 Claims, 30 Drawing Figures

PRETENSIONED CATENARY FREE DEEP SEA MOORING SYSTEM

FIELD OF THE INVENTION

This invention relates generally to mooring systems for marine vessels and partly submerged marine structures such as towers and more particularly to mooring systems that are designed for specific use in extremely deep water conditions. Even more specifically, the present invention is directed to a pretensioned mooring system which eliminates the catenary that is typically present when cables or other such tension devices are utilized in conventional mooring systems and allows restrained movement of the vessel or structure such as is caused by wind and wave action.

BACKGROUND OF THE INVENTION

In ocean industries and in the offshore petroleum industry, in particular, it is necessary to locate marine vessels and structures in particular relation to the sea bed and maintain these structures in stabilized condition while operations are being conducted. In the case of well drilling for petroleum exploration and production, drilling rigs are typically located on floating vessels, semi-submersible vessels or bottom supported platforms. In each case, and especially so in the case of floating vessels and semi-submersible vessels, it is necessary to maintain the drilling rig in a rather precise location relative to the ocean floor, to thus maintain the rotating drill stem as straight as possible as it is being rotated by the drilling rig. Bottom supported platforms are widely used in relatively shallow water conditions, for example in water depths up to 600 feet. The lower portion of such bottom supported platforms is secured to the ocean floor by means of piles that are driven to desired depths. When wells are drilled in water depths exceeding 1000 feet, it is typical to employ floating or semi-submersible drilling vessels which are anchored in place by means of cables extending from various connection points on the vessel to anchoring devices that are secured to the ocean floor. These anchoring or mooring cables are typically connected to cable winches located on the drilling vessel thereby permitting cable adjustment sufficient to maintain the vessel positioned substantially over the well bore being drilled.

Wave action, wind and current acting upon floating vessels, and tall and slim marine structures cause lateral shifting or excursion of the marine structures. Because of the catenary that forms in conventional mooring cables, the forces of wind, current and wave action can cause tightening of the cables on one side of the vessel and consequent loosening of the opposite cables, thus allowing the vessel or structure to shift laterally. The amount of lateral shifting or excursion that occurs depends on the forces applied to the vessel and to the curvature present in the mooring cables or chains. Drilling activities can take place only when the structure or vessel is maintained within prescribed limits of lateral excursion. For example, a conventionally moored floating or semi-submersible vessel in 600 feet to 1,000 feet of water will be capable of lateral excursion in the order of 45 feet because of the catenaries defined in the mooring cables. Drilling activities can be conducted, however, only when drilling vessel misalignment above the well bore is maintained to within about three percent of water depth. Under circumstances where wind, wave action and current cause the vessel to shift laterally beyond the maximum prescribed for drilling, drilling operations must cease. When drilling operations are being conducted in marine environments where stormy conditions occur frequently, for example in the North Atlantic and North Sea areas, drilling rigs are frequently required to shut down simply because the weather conditions, wave action and currents cause lateral excursion of the drilling rig beyond acceptable limits. This, of course, is detrimental to the cost of drilling operations because the fixed costs of maintaining the vessel, equipment and personnel continues during such periods of inactivity. It is, of course, desirable to provide a mooring system for floating and semi-submersible drilling rigs which will significantly reduce the amount of down time that is presently due to adverse weather conditions.

It is desirable to provide a mooring system having no catenaries and thus efficiently minimizing lateral excursion in response to forces generated by wave action, wind and current and maintaining the structure stable within allowable limits.

As exploration for petroluem continues in the ocean environment, the need for drilling operations in water of greater depth becomes more desirable. At the present time, offshore drilling operations are being conducted from at least one bottom supported platform in water as deep as slightly under 1000 feet which is presently considered record water depth for bottom supported platforms. Actually, approximately 600 feet of water is considered to be the practical limit for bottom supported platforms from the standpoint of cost and productivity.

A tension leg platform system is being developed at the present time by Conoco, Inc., which is scheduled to be operating in the Hutton Field in the North Sea by 1984. The tension leg design concept utilizes a semi-submersible marine vessel and a plurality of structural members that link the platform to the sea floor in tension rather than compression. The tension leg system provides restoring forces that tend to recenter the vessel above the well being drilled if lateral excursion should take place. The tension legs secure the vessel in such manner that it is relatively insensitive to wave action from the standpoint of rising and falling. However, the vessel will be subject to lateral shifting in response to wave action, current and wind. For example, on the basis of model basin tests, the maximum excursion in a design storm with 98 foot, 17 second waves, accompanied by a 95 knot wind and 2.5 knot currents, all impinging on the platform from a 45° angle, will be 79 feet. The tension leg platform system is discussed in the February, 1980 issue of *Ocean Industry*, at pages 35–39. Although a platform of tension leg design will have less lateral excursion than conventionally moored floating and semi-submersible vessels, better productivity of tension leg drilling systems could be accomplished if lateral excursion were further restricted by a catenary free mooring system.

The catenary free mooring system of this invention is protected against the otherwise damaging effects of sagging and snap loads by means of automatic sagging preventers which interconnect each of the moors to the vessel or structure being moored. The automatic sagging preventer applies a pretension load to each of the moors while at the same time accommodating differences in the length of the individual moors. Moreover, the automatic sagging preventer maintains each of the moors under tension even during lateral excursion of the vessel or structure such as is induced by environmental conditions such as wind loads, wave action and current.

SUMMARY OF THE INVENTION

It is, therefore, a primary feature of the present invention to provide a novel catenary free mooring system for floating vessels, semi-submersible vessels and slim and tall bottom supported structures wherein the mooring system is maintained under predetermined tension at all times to thus provide sufficient mooring to minimize lateral excursion of marine vessels and structures.

It is another feature of this invention to provide a tensioning system for a catenary free mooring system which maintains each mooring line under predetermined tensions even during lateral excursion by wave and wind action.

It is a further feature of this invention to provide a a novel mooring system that is capable of being submerged and has substantially neutral buoyancy and neutralized hydrostatic pressure when submerged, thus preventing the development of catenaries and provide approximately equal longitudinal, shear and hoop stress to each member of the moor.

It is another feature of this invention to provide a novel catenary free mooring system which includes automatic sagging prevention to compensate for loads induced to the moors by action of waves, current and wind.

Basically, the present invention concerns the provision of a pretensioned neutrally buoyant heavy duty deep sea mooring system which maintains substantially neutral or weightless conditions in the sea and thus does not develop a catenary. The catenary free mooring system of this invention incorporates a plurality of elongated tension members which are interconnected in end-to-end relation by suitable connecting means. The elongated tension members and connecting means are designed to displace a volume of water substantially equal to the combined weight thereof. The mooring system is, therefore, in the form of an elongated articulated chain having a lower extremity adapted to be secured to a suitable anchor on the ocean floor. The upper extremity of the articulated mooring chain is provided with an automatic sagging preventer which is secured to the vessel or structure being moored. The connection to the vessel may be either above, at or below the water line. It should be born in mind, however, that only the submerged portion of the mooring system will be catenary free. The articulated mooring chain is maintained under predetermined tension and thus extends in straight line manner from the mooring anchor at the ocean floor, upwardly and in angular relation to the surface of the water. Since the articulated mooring chain is maintained in catenary free straight line relation by virtue of its neutral buoyancy in water, lateral excursion of the vessel or structure to which the upper extremity is connected is permitted only within the limits of the tension elongation that is allowed to occur as excursion inducing forces are resisted plus the extension of the tension adjustor.

Each of the plurality of radiating mooring chains is defined by a plurality of interconnected sections, the sections being interconnected in articulated manner. In one form of the invention, each of the sections is defined by elongated tubular members having end caps connected thereto which form an internal flotation chamber containing a pressurized gas such as air, nitrogen, helium, etc., to neutralize hydrostatic pressure. The wall thickness of the tubular member is such, as compared to the diameter thereof, so as to develop a slightly positive buoyancy in water. The connecting devices, such as single chain links that interconnect the tubular members in assembly, offset this slightly positive buoyancy and thereby render the combined buoyancy of the tubular member and connection structure substantially neutral. Thus, the elongated tension mooring system will be substantially weightless in water and, therefore, will not develop a catenary. Any excursion introducing force applied to the vessel or structure will be readily resisted by the tension restraining forces of the mooring system. A pretensioning mechanism interconnects each mooring chain to the vessel or other structure and maintains the chain under predetermined pretension.

Each of the end caps of the elongated tubular members is formed to define a connecting eye or other suitable form of connection. A single chain link or a few chain links may interconnect the connection eyes of adjacent end caps thereby providing the articulated connection that is desired. In the alternative, the end cap portions may be interconnected one to another by a joint shackle manner so as to provide an articulated tension resisting connection between the elongated tubular members.

For use in water of suitable depth the flotation chambers defined within the tubular members will be pressurized prior to installation in order to compensate for the hydrostatic pressure of the sea water. In extremely deep sea conditions, the internal chambers of the tubular members will be prepressurized to the maximum pressure limit allowed in atmospheric pressure conditions prior to installation. After installation to a maximum depth for prepressurized tubular members, submerged apparatus will introduce additional pressurization to the flotation chambers, thereby enabling the tubular members and end caps to withstand extremely great hydrostatic pressures. Thus, the mooring system may be effectively utilized in any suitable water depth, providing a more effective anchoring system than is presently available through utilization of cable or chain type mooring systems.

To compensate for the forces that are induced by the action of wind, waves and ocean current, the mooring system is pretensioned by an automatic sagging preventer. The function and design of the automatic sagging preventer is somewhat similar to the suspension system of an automobile. The automatic sagging preventer basically comprises a pair of hydro-pneumatic cylinders and a spring. The hydraulic cylinders are connected to a master compressed air chamber. The automatic sagging preventer allows maintenance of at least the preset tension on all the mooring lines simultaneously under various load conditions due to the action of waves, current and wind. The automatic sagging preventer prevents sagging of the moor and snapping load to the moor, and reduces dynamic impact load of the mooring system.

Elimination of the the effects of moor sagging enables the use of lower pretension force levels of the moors. Consequently, the required design load of the moor can be lowered. This feature reduces the required diameter of the buoyant tube chain, thus reducing the wave/current force on the buoyant tube chains, and makes the buoyant tube chain moors a more practical mooring system in the deep sea environment. Even further, the lower the tension in the moor, the longer the resonant period of the transverse vibration of the mooring line. This feature makes the resonant period of the moor apart from the dominant wave period. This reduces the possible problem of dynamic amplification of the mooring system.

Other and further objects, advantages and features of the present invention will become apparent to one skilled in the art upon consideration of this entire disclosure. The form of the invention, which will now be described in detail, illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of this invention will become apparent and can be understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of the invention and are, therefore, not to be considered limiting of its scope, for the invention may admit to other equally effective embodiments.

IN THE DRAWINGS

Figure 1A:
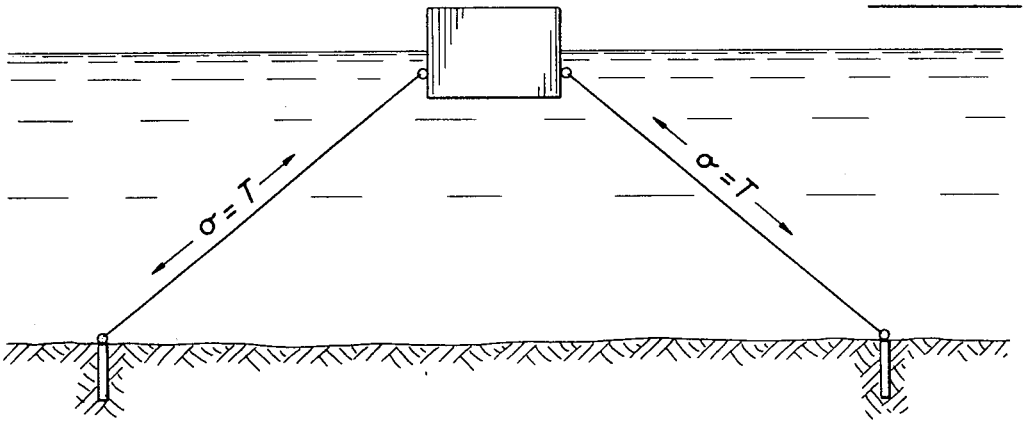
FIG. 1a PRIOR ART
Figure 1B:
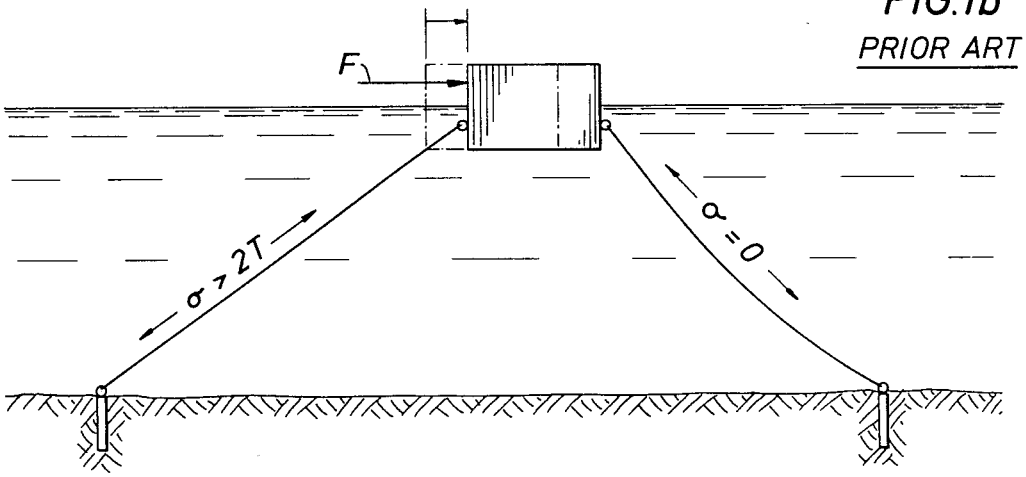
FIG. 1b PRIOR ART
Figure 1C:
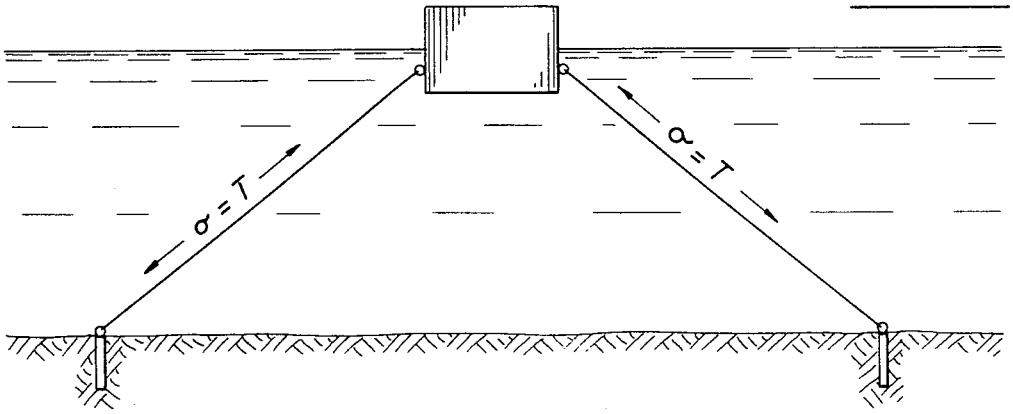
FIG. 1c PRIOR ART

FIGS. 1*a*, 1*b* and 1*c* are diagrammatic representations of the cause and effect of sagging and snap loads on mooring systems.

Figure 2:
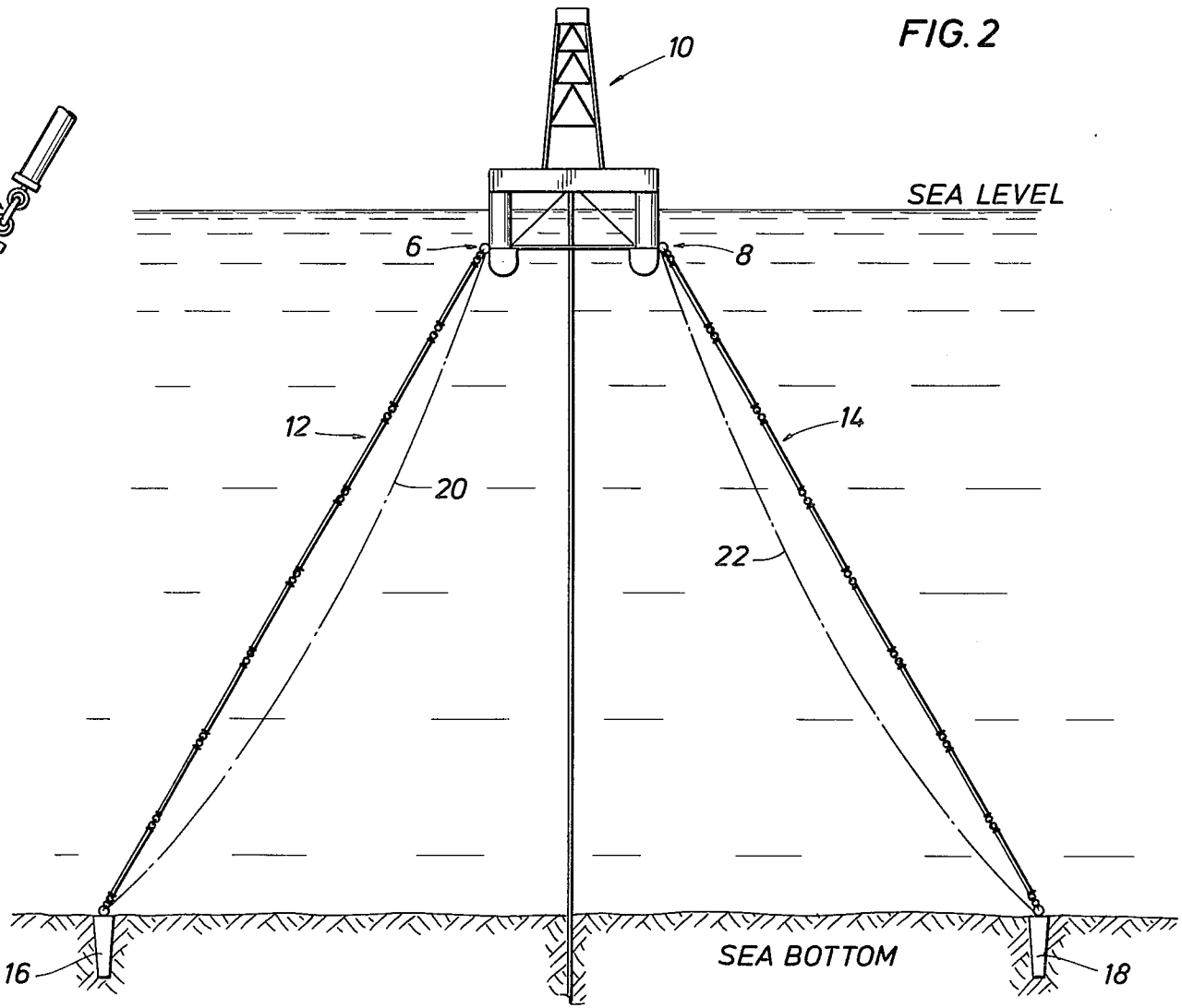

FIG. 2 is an elevational view of a marine environment showing a semi-submersible drilling vessel being moored by a catenary free mooring system consructed in accordance with the present invention.

Figure 2A:
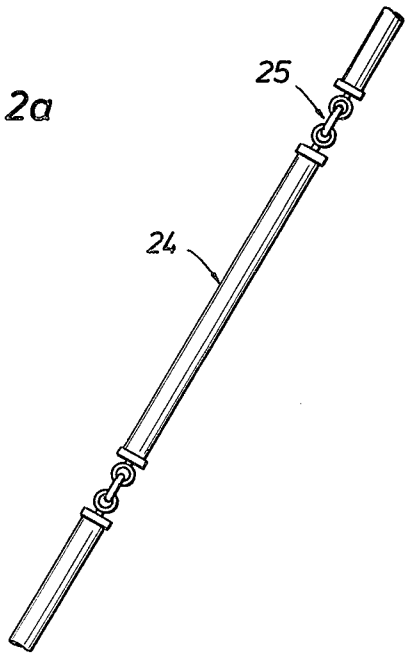

FIG. 2*a* is a partial view of one of the mooring chains of the mooring system of FIG. 2, showing the assembled relation of chain sections in greater detail.

Figure 3:
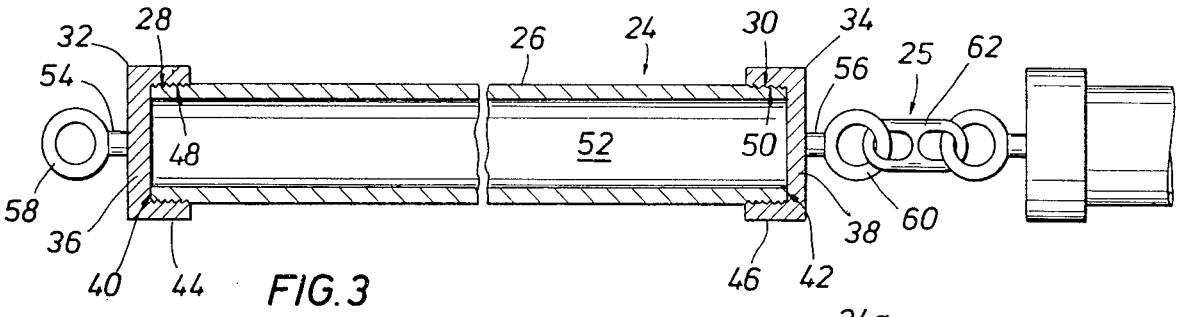

FIG. 3 is a sectional view of one of the buoyant chain sections of FIGS. 2 and 2*a*, illustrating the assembled condition of the structural components thereof.

Figure 4:
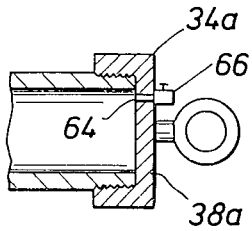

FIG. 4 is a fragmentary sectional view of an end portion of a catenary free mooring device representing another embodiment of the invention and illustrating the provision of a gas introduction valve that is utilized to prepressure the internal gas containing chamber prior to installation and to introduce additional pressurization after installation at the water depth limit for prepressurization.

Figure 5A:
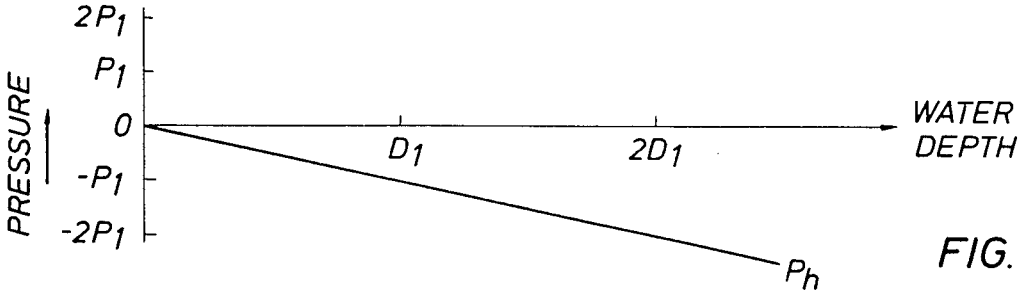
Figure 5B:
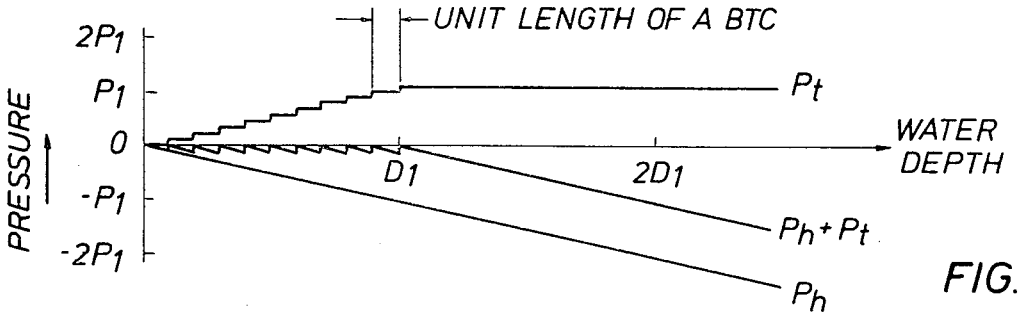
Figure 5C:
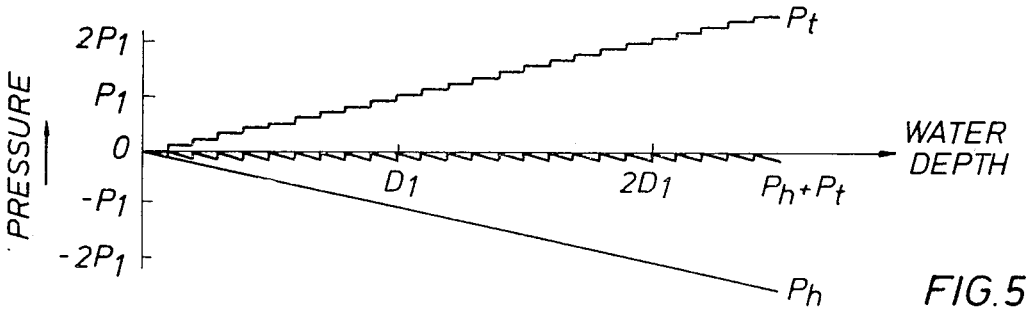

FIGS. 5*a*, 5*b* and 5*c* are graphical representations reflecting internal tube pressurization and hydrostatic pressure at various water depths and which indicates the vertical limitless depth of the mooring system of this invention.

Figure 6:
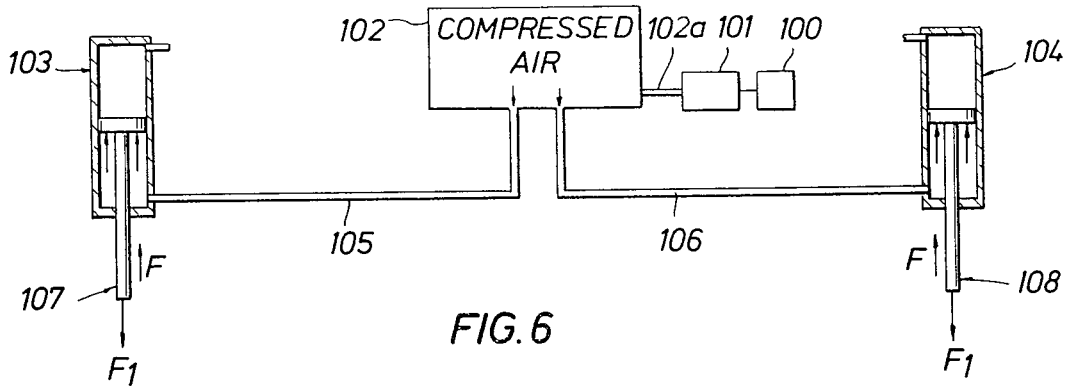

FIG. 6 is a schematic diagram representing a tensioning mechanism for the automatic sagging preventer of the mooring system of this invention.

Figure 7A:
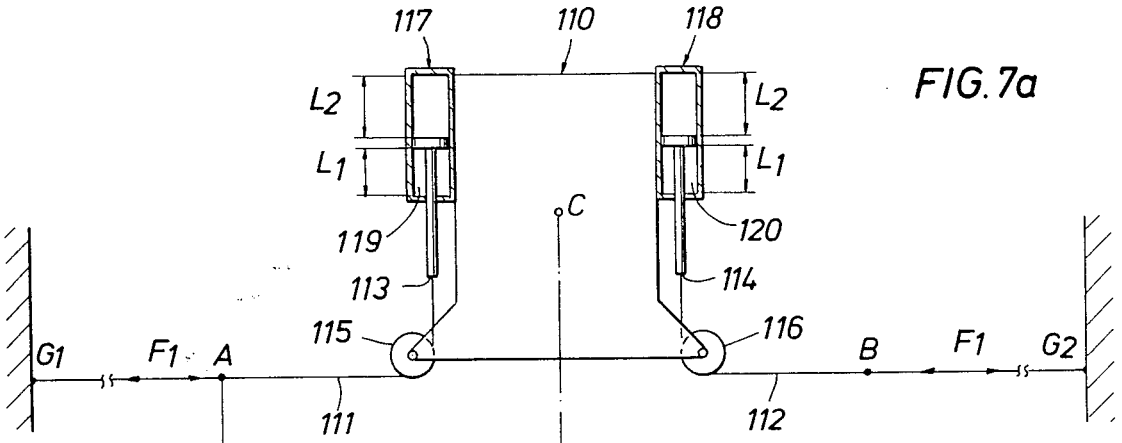
Figure 7B:
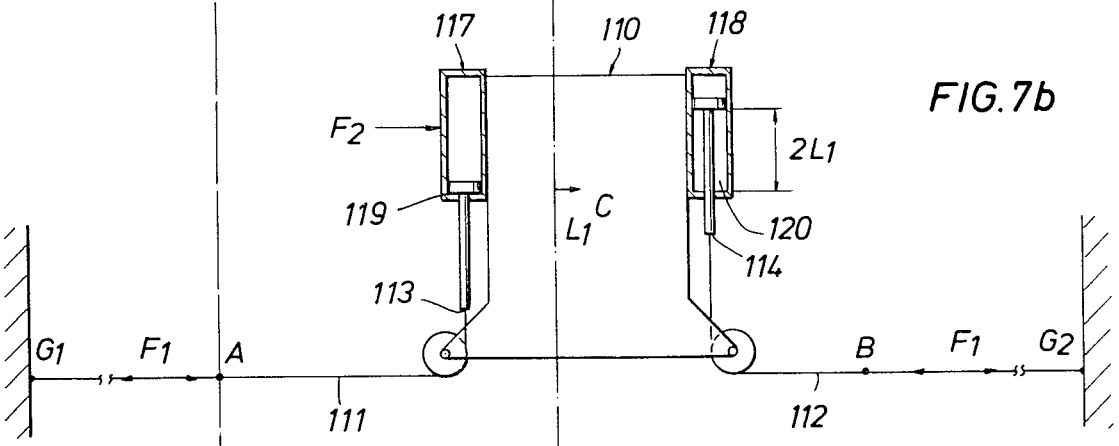
Figure 7C:
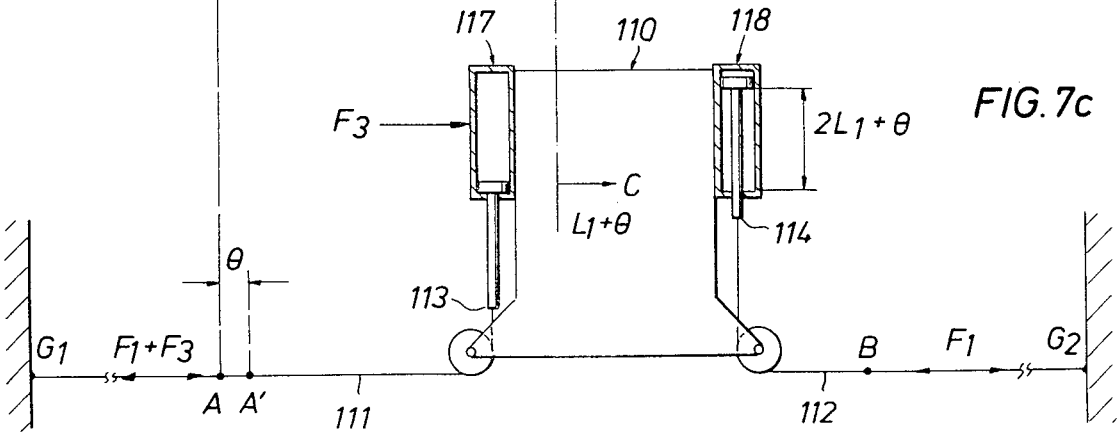

FIGS. 7*a*, 7*b* and 7*c* are simplified representations of a two dimensional view of a moored vessel or structure provided with a tensioning mechanism such as depicted in FIG. 7.

Figure 8A:
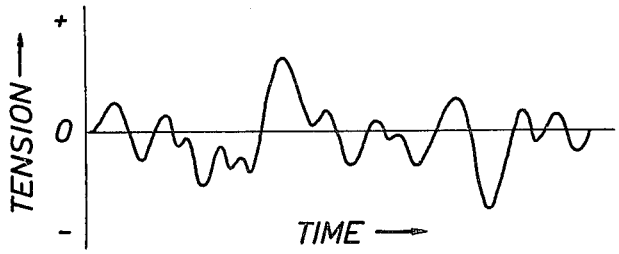
Figure 8B:
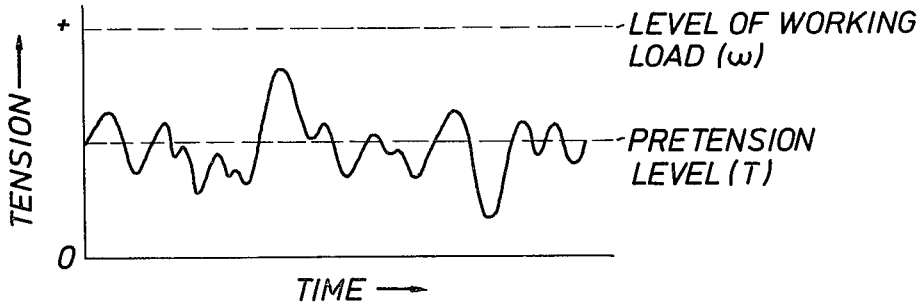
Figure 8C:
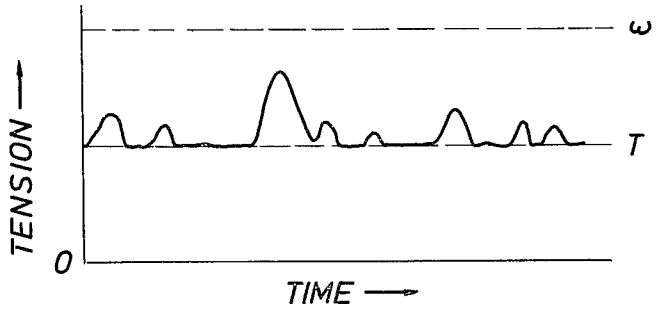
Figure 8D:
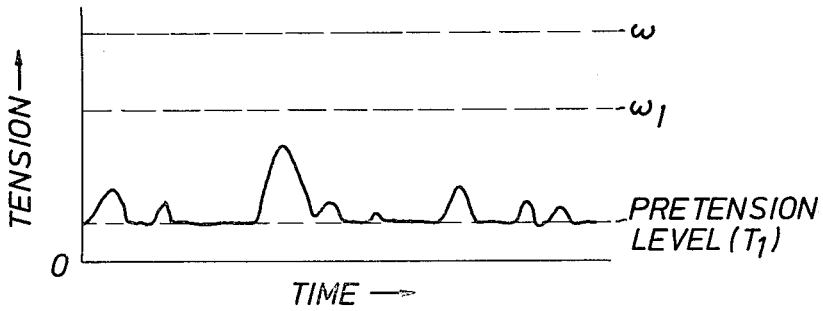

FIGS. 8*a*, 8*b*, 8*c* and 8*d* are graphical representations of tension variation in a mooring system and the effects of environmental induced force thereon; FIG. 8*a* representing zero tension level while FIGS. 8*b*, 8*c* and 9*d* represent application of pretension. In FIGS. 8*c* and 8*d* the pretension load is applied with an automatic sagging preventer.

Figure 9B:
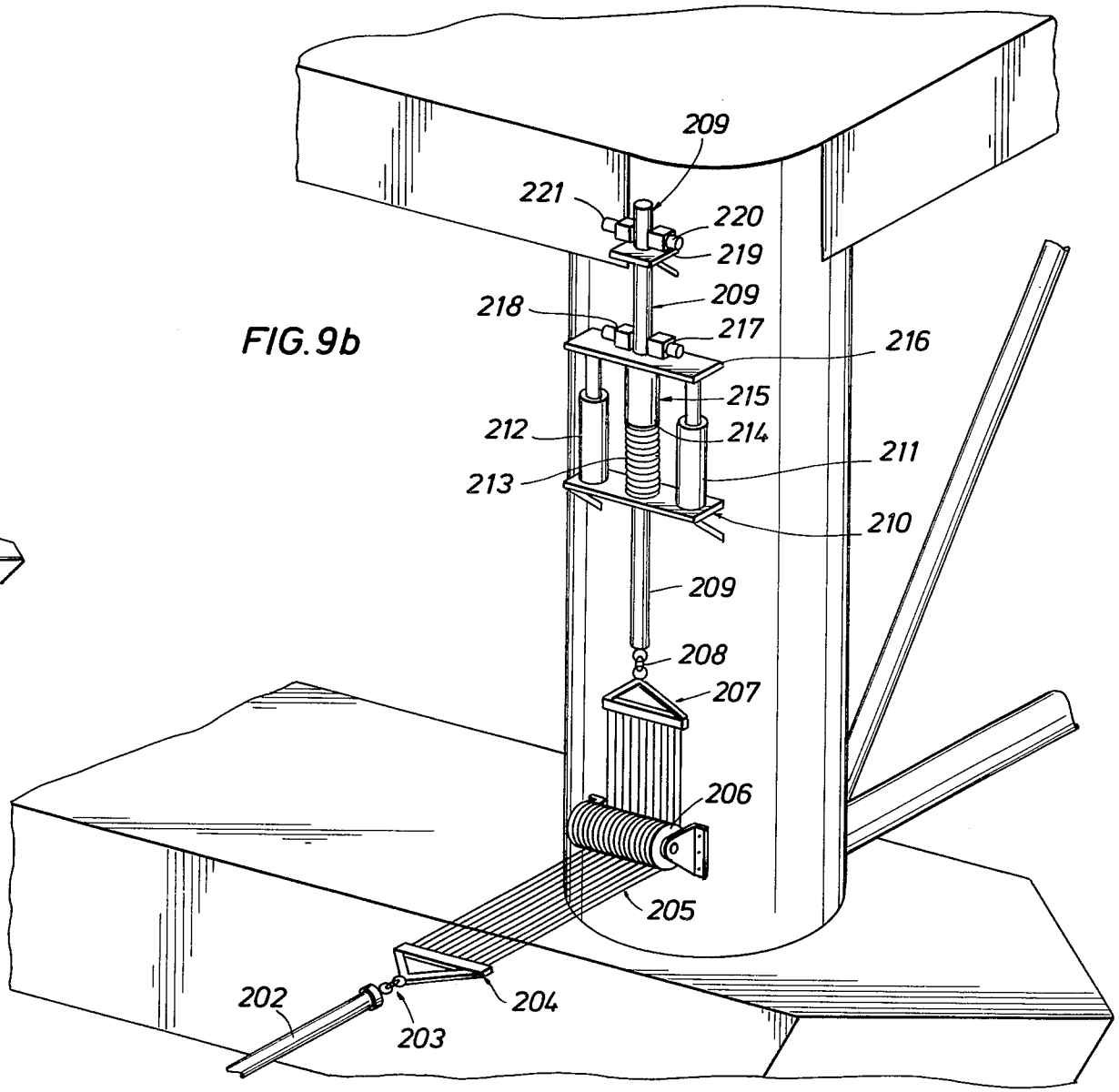
Figure 9A:
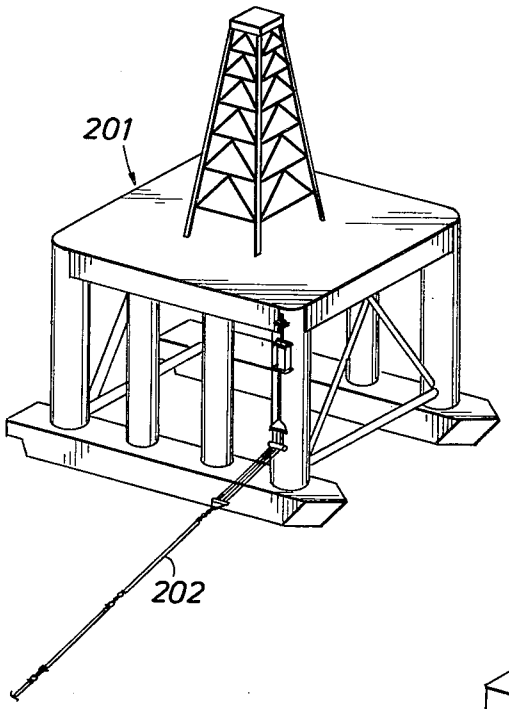

FIG. 9*a* is an isometric view illustrating a typical semi-submersible drilling platform provided with a buoyant tube chain mooring system having an automatic sagging preventer. Only a single moor is depicted for purposes of simplicity.

FIG. 9*b* is a partial isometric view illustrating one leg or column of the platform of FIG. 9*a* and illustrating the automatic sagging preventer in greater detail.

Figure 10A:
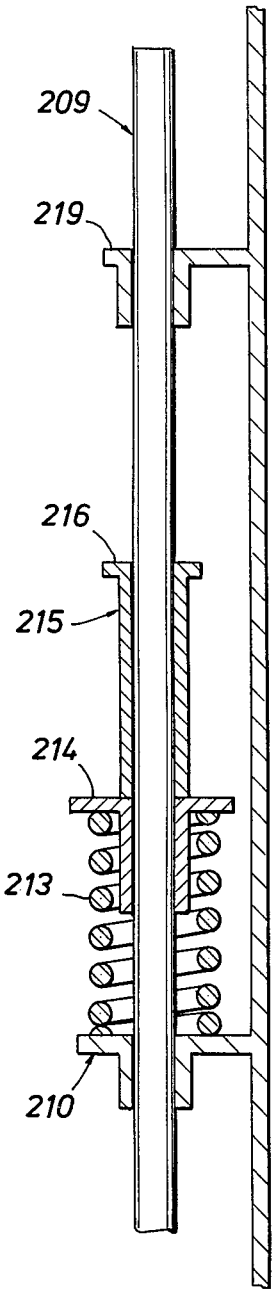

FIG. 10*a* is a side view in partial section illustrating the platform leg shown in FIG. 9*b* and further illustrating a stand for the tensioning mechanism which is fixed to the platform leg or column.

Figure 10B:
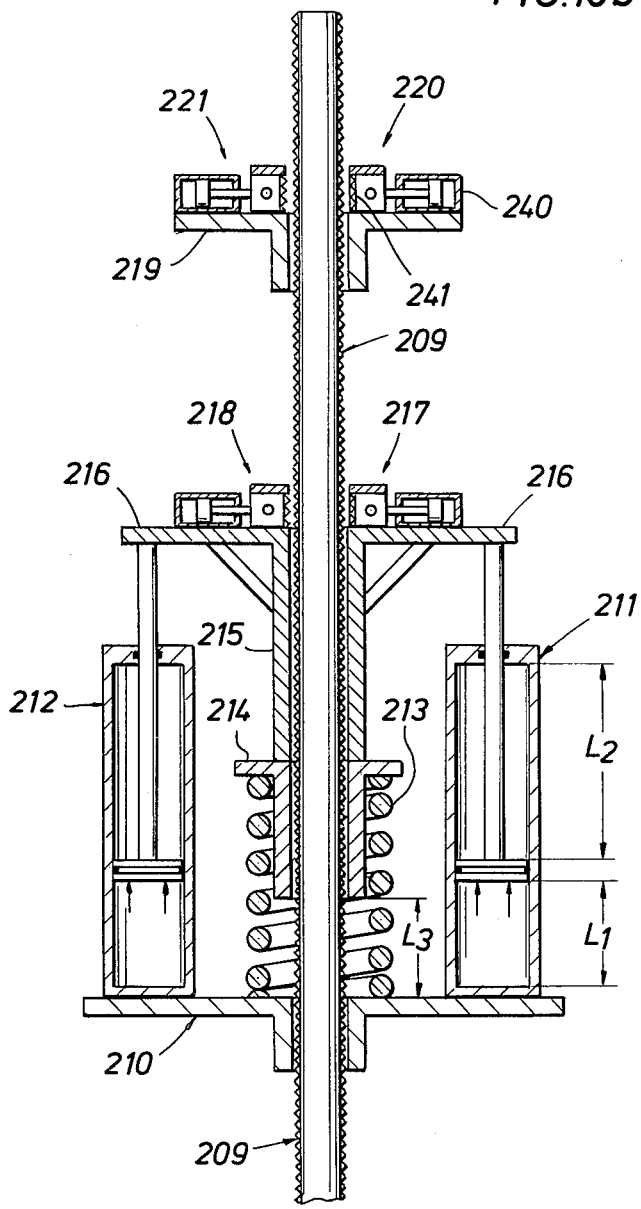

FIG. 10*b* is a front view in partial section illustrating the tensioning mechanism of FIG. 10*a* in further detail.

Figure 10C:
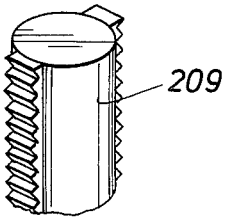

FIG. 10*c* is a fragmentary isometric view illustrating the upper portion of the tension transfer rod and showing the detailed construction thereof.

Figure 10D:
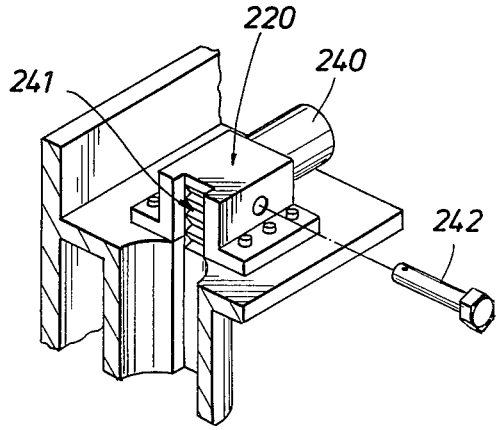

FIG. 10*d* is a fragmentary section view illustrating the locking mechanism at the upper portion of the sagging preventer of FIG. 10*b*.

Figures 11A, 11B, 11C:
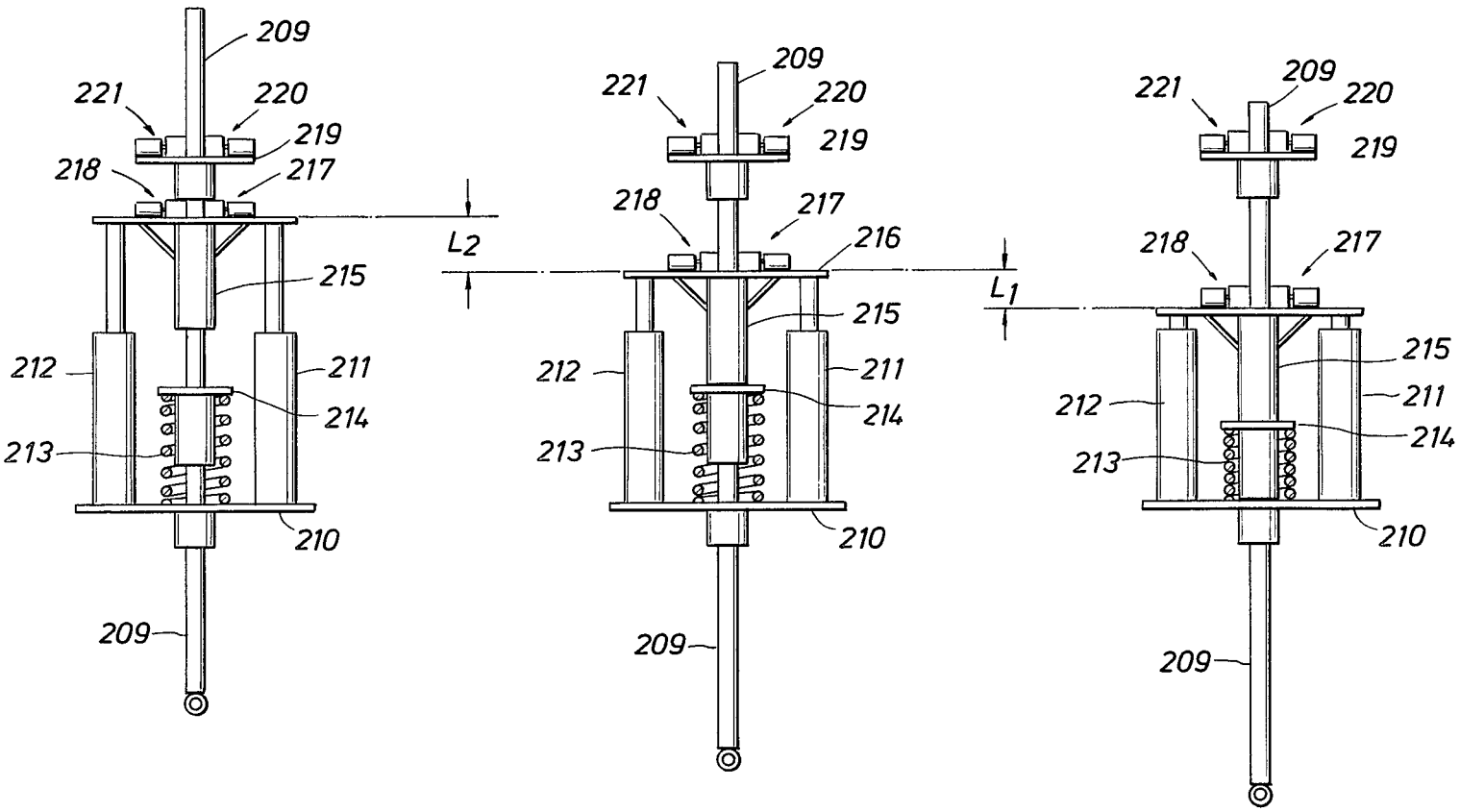

FIGS. 11*a*, 11*b* and 11*c* illustrate the tensioning mechanism under various load conditions.

Figure 12A:
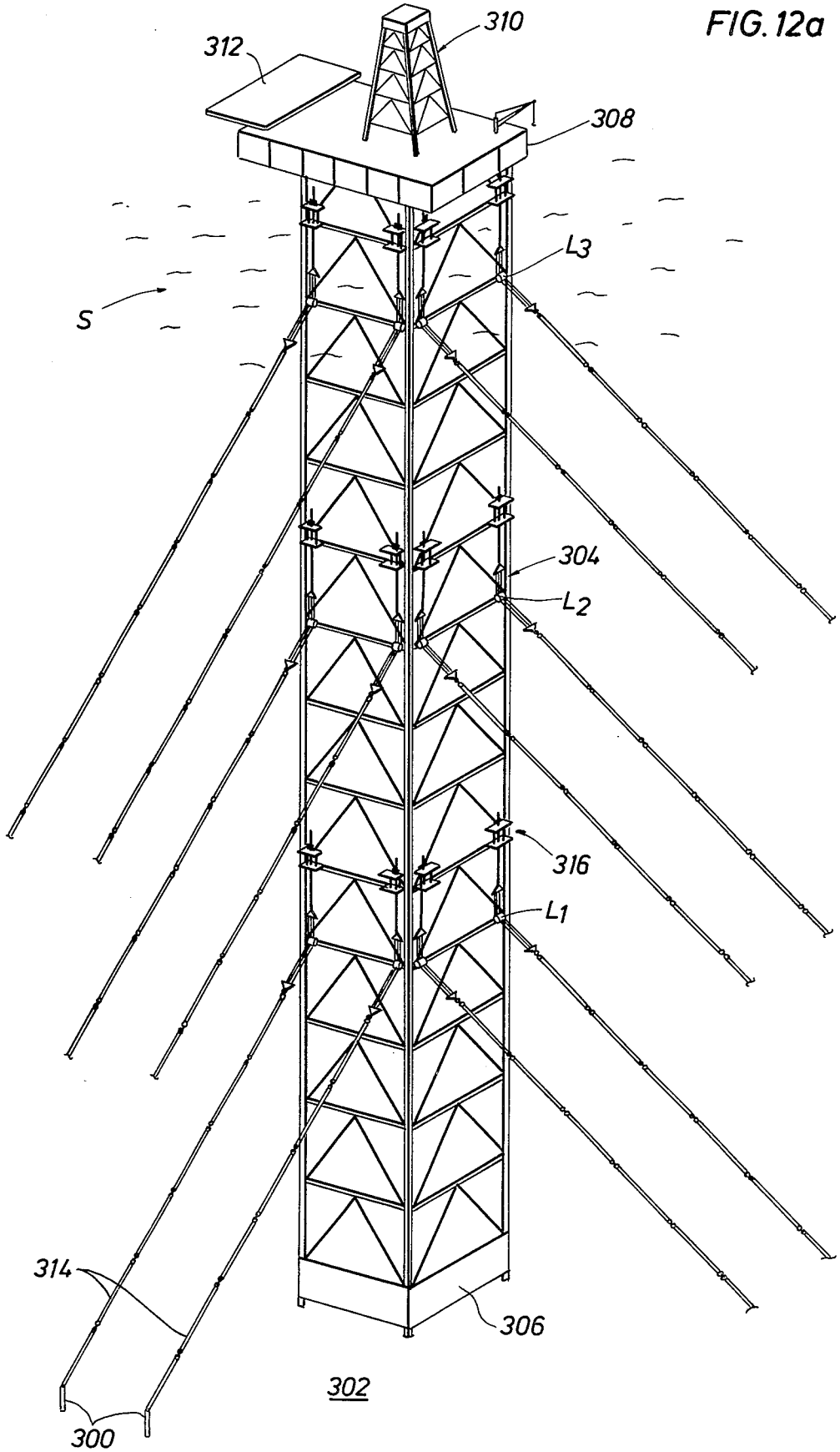

FIG. 12*a* is a pictoral representation of a platform tower resting on the sea bed and moored by means of multiple pretensioned mooring chains according to this invention.

Figure 12C:
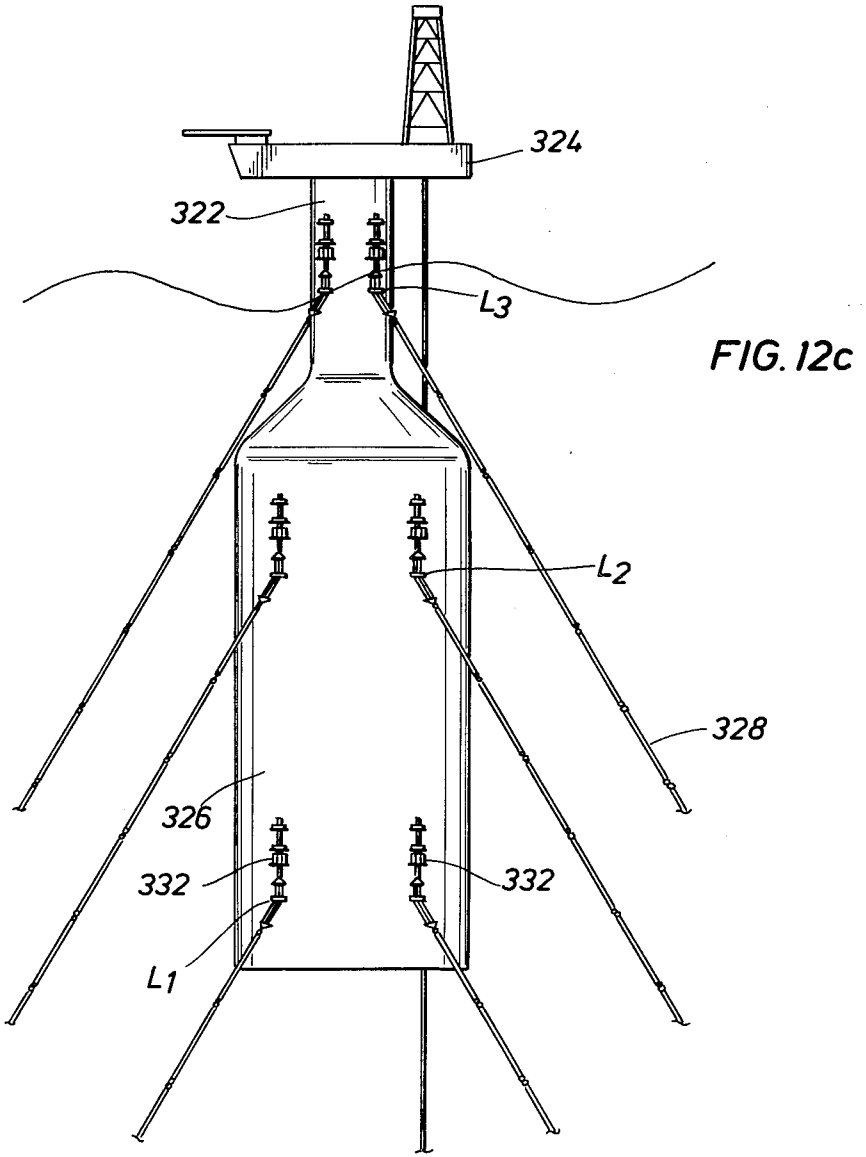
Figure 12B:
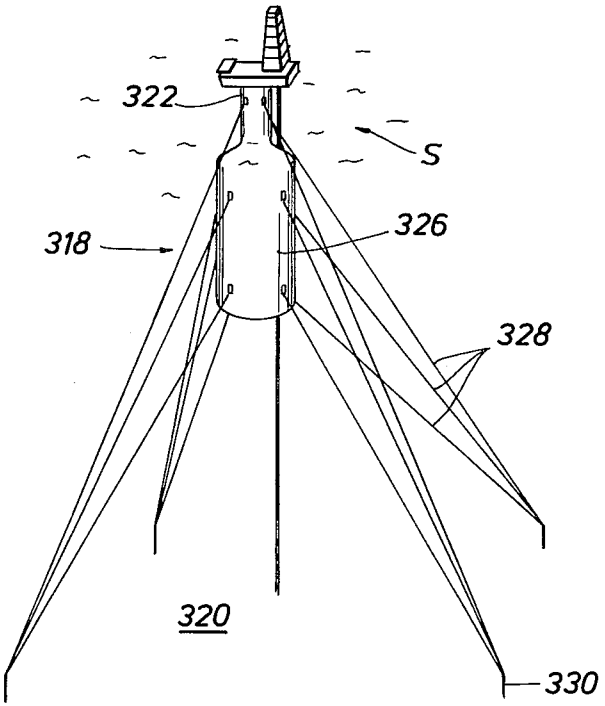

FIG. 12*b* is a pictoral representation of a floating drilling and production platform wherein a pretensioned catenary free mooring according to this invention is employed for excursion control.

FIG. 12*c* is a pictoral representation similar to that of FIG. 12*b* illustrating the mooring system in greater detail.

DETAILED DESCRIPTION OF PREFERRED EMBODIMENT

The basic concept and merits of the catenary free mooring system has been known for many years. However, this idea haas never been widely implemented in the ocean industries partly because the necessary materials and technology to build such a system have not been available and partly because there has been no practiced means available to overcome a few inherent problems of pretensioned catenary free mooring systems. These problems are:

1. Sagging. Referring now to the drawings, a two dimensional sketch of a pretensioned catenary free mooring system is depicted in FIG. 1*a*. In this figure, a preset tension T is applied to both sides of the moor. When the external force F is applied to the vessel, the vessel moves to the *right side* as shown in FIG. 1*b*. due to this vessel movement, the tension on the *left-hand side moor will increase* and the right side will decrease. When the tension on the left-hand side moor becomes equal to or greater than 2T, that on the right-hand side will become zero and sagging takes place on the moor at the right-hand side. When the external force F is removed, the vessel will move back to the left-hand side due to restoring force stored in the moor at the left-hand side. Particularly when the external force F is removed suddenly then the sagged moor at the right-hand side will receive a sudden force, typically referred to as a snap load. The snapping effect of the mooring line when suddenly loaded in this manner will induce a severe impact load to the mooring system as well as the vessel.

2. Extreme Rigidity and Impact. The elastic elongation of a pretensioned catenary free moor amounts to a few thousandths of an inch per linear foot of the mooring line if it is made of steel. This minimal elastic elongation allows very little displacement of the vessel or the structure even during extremely adverse environment conditions, such as in heavy seas cause by storms. Consequently, the oscillating component of the environmental force due to wave action will induce severe impact loads to the mooring system as well as to the vessel or structure that is moored.

In order to overcome the above stated problems of a pretensioned catenary free moor and the depth limitation of the catenary free mooring system, the present invention provides a catenary free mooring system for deep sea application which comprises prepressurized tube chains and includes an automated sagging preventer system.

CATENARY FREE BUOYANT TUBE CHAIN

Referring now to FIG. 2, a marine environment is illustrated with the ocean floor and seal level identified and with a semi-submersible drilling vessel illustrated generally at 10 moored by means of a substantially catenary free mooring system constructed in accordance with the present invention. The substantially catenary free mooring system incorporates a plurality of elongated mooring chain devices shown generally at 12 and 14 which are connected at the lower extremities thereof to anchors 16 and 18 at the ocean floor and connected at the upper extremities thereof to pretensioning devices 6 and 8 of the drilling vessel 10. Although only two elongated mooring devices or chains are shown at 12 and 14, it is to be understood that for adequate mooring of a vessel such as a semi-submersible drilling vessel, four or more elongated mooring chains will be utilized which will radiate from the drilling vessel to submerged anchors such as at 16 and 18.

In broken line, FIG. 2 illustrates the typical catenaries that are developed as typical mooring cables 20 and 22 are extended in radiating manner from a vessel or structure to submerged anchors. As mentioned above, as wind, wave action and current induce severe lateral excursion forces to the vessel or structure being moored, the catenaries on one side will straighten somewhat due to the additional tensional force applied thereby causing the vessel or structure to shift laterally. This lateral excursion will cause the opposite catenaries to decrease the radius of catenary curvature. As also mentioned above, drilling vessels can tolerate a minimal amount of lateral excursion due to weather and current induced forces. When lateral excursion exceeds the maximum level for which the drilling equipment is designed, the drilling operation must cease. It is desirable, therefore, to provide a mooring system having the capability of more efficiently maintaining the vessel on station against such lateral excursion forces and thereby minimize drilling down time due to weather and current induced conditions.

As shown at the left side portion of FIG. 2, each of the elongated buoyant chains of the tension mooring device may conveniently take the form shown in FIG. 2*a*. A plurality of elongated, generally rigid tension members shown generally at 24 are provided and each of the tension members are interconnected in articulated manner by means of connection devices illustrated generally at 25.

Referring now to FIG. 3, each of the elongated tension members 24 comprises an elongated substantially rigid tubular member 26 which is in the form of a hollow tubular element. Typically, the tubular member 26 is of cylindrical configuration and is simply formed by a length of large diameter steel pipe, for example pipe having an outer diameter in the order of 25 inches and a length in the order of 50 feet.

As mentioned above, it is desirable to eliminate the formation of catenaries in a mooring system to thus minimize lateral excursion that results. For a catenary free mooring system, it is necessary that the elongated mooring chain be self-buoyant to the extent that it has a substantially neutral buoyancy in water. This causes the mooring chain to be substantially weightless in water and this weightless condition prevents the development of catenaries. To provide this self-buoyancy, in one suitable form of the invention each of the elongated tension members will be of hollow configuration, thereby defining an internal flotation chamber. The apparatus may conveniently take the form illustrated in FIG. 3, wherein the elongated tubular member 26 is formed to define externally threaded portions 28 and 30 at each extremity thereof. A pair of end caps 32 and 34 are provided, each having respective end walls 36 an 38 that engage respective end surfaces 40 and 42 of the tubular member 26 and establish a water tight seal therewith. A pair of annular retainer rims 44 and 46 extend from the outer peripheral portions of the respective end walls 36 and 38 of the end caps 32 and 34. The retainer rims 44 and 46 define internal threads 48 and 50 that receive the respective externally threaded portions 28 and 30 of the tubular member 26, and thus retain the end caps 32 and 34 in positively secured and locked and sealed engagement with the end surfaces 40 and 42 of the tubular member. The seal between the end caps and the end surfaces of the tubular member is a metal-to-metal seal which is formed as the end caps are threaded into place on the tubular member and seated with high mechanical force. If desired, however, the end caps may be sealed in any other suitable manner and may be retained by welding in lieu of or in addition to mechanical interengagement such as by means of threads. Thus, the end caps 32 and 34 cooperate with the tubular member 26 to define an internal flotation chamber 52 which may contain any suitable gaseous medium such as air or helium, for example.

It should be borne in mind that the end caps 32 and 34 must be secured to the elongated tubular member 26 in such manner that the designed tension forces to which the mooring chain may be subjected will be adequately within the mechanical capability on the connection means securing the end caps in assembly with the tubular member. It should also be borne in mind that, although a threaded connection is shown to be established between the end caps 32 and 34 and the tubular member 26, any other suitable form of connection may be utilized which provides an efficient, sealed relationship between the end caps and the tubular member and which also provides an effective tension restraining capability.

Each of the end caps 32 and 34 is provided with respective connecting members 54 and 56 defining connection eyes 58 and 60. Rigid chain links 62 or other suitable rigid connection means is interconnected with respective ones of the connection eyes 58 and 60 of the connection devices and also establishes connection with the connection eyes of adjacent elongated tension members. Thus, the elongated tension members 24 are connected in end-to-end relation such as by means of chain links 25 to form a buoyant tube chain of any suitable length for the purpose of establishing a catenary free mooring chain. A plurality of these catenary-free deep mooring chains may be secured by tensioning systems to a vessel to be retained in a particular position above the bottom and with the lower extremities thereof connected to suitable anchor devices that are positively fixed to the bottom of the ocean floor.

As shown in FIG. 2, an elongated tension member 24 will be capable of providing sufficient buoyancy to compensate for the weight of the chain connection members 25, thus allowing the tension member to be suspended in substantially weightless manner within water such as sea water. If:

$$d_w \times V = 2W_1 + W_2 + W_3 + W_4 \quad (1)$$

, where $W_1$: weight of an end cap $W_2$: weight of a tubular member $W_3$: weight of a chain link or other connector $W_4$: weight of air confined within the buoyancy chamber V: water replacement volume of an assembled buoyant tube chain unit $d_w$: specific gravity of sea water holds true, then a buoyant tube chain unit will maintain a weightless condition in sea water. Since a buoyant tube chain mooring system is developed by a plurality of buoyant tube chain units connected in series, the entire mooring system will maintain a weightless condition in the sea. Since tension is applied at the upper end of a buoyant tube chain mooring system defined by a plurality of buoyant tube chain units, and since the lower extremity of the mooring system secured to a fixed object at the sea bed, the mooring system will form a straight line position between the anchor point and the point of tension without forming any catenary. Since the mooring system does not define catenaries, application of force tending to cause lateral excursion of the vessel being moored will be transmitted directly from the buoyant tube chain to the anchor. Therefore, movement of the moored object will be as the result of physical elongation of the buoyant tube chain due to the tension forces applied thereto.

In order to provide a buoyant tube chain that is capable of being disposed in substantially weightless condition in sea water and which is capable of withstanding the tension loads to which drill ship mooring systems may be subjected, the cross-sectional area of the tubular member is governed by the maximum tension it is designed to withstand, the tensile strength of the material from which the tubular member is composed, and the density of the material itself.

When the flotation chamber 52 contains air or helium gas at atmospheric pressure, the buoyant tube chain mooring system may be utilized in water depths reaching a predetermined maximum considering the limits of the strength of the tubular material and the hydrostatic pressure at the water depth at the maximum depth limit. It should be borne in mind that the hydrostatic pressure of water increases linearly with increasing water depth. Because of this increasing pressure and the limitation of the strength of the material from which the tubular member 26 is composed, an unpressurized buoyant tube chain mooring system will have a depth limitation $D_1$ as shown in FIG. 6*a*. When an unpressurized buoyant tube chain is submerged, each buoyant tube chain unit will have different longitudinal and hoop stresses due to linearly increasing hydraulic pressure with depth. In order to protect the buoyant tube chain mooring system from the adverse effect of hydrostatic pressure and to increase the depth limitation of the mooring system, it is necessary to prepressurize the buoyancy chamber with a gaseous medium such as air, helium, etc. For the purpose of prepressurization, one of the end caps 32 or 34 may be provided with a gas transfer valve 66 in the manner illustrated in FIG. 4. As shown in FIG. 4, the end cap 34*a* is formed such that the end wall 38*a* defines a gas transfer passage 64. A gas valve 66 is connected to the end wall 38*a* and is in communication with the gas transfer passage 64. Any suitable prepressurizing device, such as a gas compressor, pressurized air or helium bottles, etc. may be secured to the gas valve 66 in order to introduce pressurizing gas into the flotation chamber 52. In FIGS. 5*a*, 5*b* and 5*c*, ($p_1$) is the limiting pressure of the tubular member 26 due to the limits of the strength of the tubular material and ($D_1$) is its corresponding depth limit. The hydrostatic pressure ($P_h$), the inside pressure ($P_t$) of compressed gas, and the combined pressure ($P_h+P_t$) after the prepressurized buoyant tube chain is installed to its appropriate water depth are depicted in the graphical representation of FIGS. 5*a*, 5*b* and 5*c*.

Obviously, the buoyancy chamber 52 may be prepressurized to a particular maximum pressure depending upon the yield strength of the material from which the tubular member and the end caps are composed. Since the internal tube pressure ($P_t$) of the tubular member cannot be increased beyond $P_1$ in the atmospheric pressure, there is provided a constant pressure within the tubular member which is equal to $P_1$ beyond the depth of $D_1$. This pressurization can increase the maximum depth limit to $2D_1$ (FIG. 5*b*).

To increase the depth limitation of $2D_1$, it is necessary to adjust the internal pressure to compensate for hydrostatic pressure. The flotation chamber 52 of the tubular member must be pressurized to accommodate the hydrostatic pressure at the depth to which it is to be submerged. After the tubular members have been submerged to a depth $D_1$ where the hydrostatic pressure is $P_1$, it may again be pressurized up to $2P_1$, then allowing them to descend to a depth $2D_1$ where the hydrostatic pressure is $2P_1$ and so on. Submerged pressurization may be accomplished through the use of gas supply hoses connected to surface located pressurizing equipment or by means of a submarine system with portable gas supply means on board. This method will increase the maximum depth limit of the mooring system to any desired depth. After the depth variant pressurization, as can be seen in FI. 5*c*, $P_h+P_t$ can be almost zero at any water depth and thus the buoyant tube chain mooring system becomes almost a pure tensional system if the inside pressure ($P_t$) is adjusted the same as the hydrostatic pressure ($P_h$) along the water depth.

The catenary free buoyant tube chain mooring system of this invention is advantageous because of a number of desirable characteristics. The mooring system is self-buoyant and does not require any external attachments, such as buoys, to eliminate the development of catenaries. By providing a depth variant pressurization, it is possible to extend the depth capability of the mooring system thereby providing a catenary free mooring system that is insensitive to water depth. Further, the vessel being moored or structure being supported is not subjected to the weight of the mooring system, but rather is capable of being moored solely in response to the tension that is applied from the vessel or marine structure and the anchor points at the sea bed.

Since the mooring system is composed principally of tubular tension members, it has limited elongation in tension. The buoyant tube mooring system is of simple design and may be manufactured and installed well within the financial parameters for cable and chain type mooring systems.

Because of the neutral buoyancy of the buoyant tube chain mooring system in the water, installation of this system can be much simpler than conventional mooring chain systems. The mooring system may be efficiently stored in the marine environment simply by tethering one end of it to the vessel or structure and by providing sufficient weight at the opposite end to sink it below the level of other marine operations. The mooring system may be efficiently stored on the ocean floor until its use is desired. Even though it may be of great size, the marine equipment to handle the mooring system need not be unduly massive or have extremely great capacity because of its weightlessness in the water.

AUTOMATED SAGGING PREVENTER

A schematic diagram of a tensioning device for the automated sagging preventer is depicted in FIG. 6. A motor 100 is utilized to drive an air compressor 101 which is in turn connected to a compressed air chamber 102 via a compressor discharge pipe 102*a*. A pair of tension type hydra-pneumatic cylinders 103 and 104 are connected to the air chamber via pipes 105 and 106. The pistons of the cylinders are connected to piston rods 107 and 108. The mechanism depicted in FIG. 6 is a linear tension device and the extension force F of piston rods 107 and 108 are proportional to the air pressure of the air chamber 102. If the volume of the air chamber is much greater than that of the cylinders, the pressure change in the cylinders will be negligible when the piston changes its position due to the external force $F_1$ applied to the piston rods 107 and 108. Tensioning devices of a few hundred ton capacity, which can be utilized for a tensioning system such as described in FIG. 6, are readily available in the market by a few manufacturers.

FIG. 7*a* is a simplified two-dimensional view of a moored vessel provided with a tensioning mechanism such as depicted in FIG. 6. The vessel 110 is horizontally moored by a pair of catenary free mooring cables 111 and 112. The cables 111 and 112 are connected to the ends of the piston rods 113 and 114 through sheaves 115 and 116. It is assumed that the distance between $G_1$ and A is the same of B to $G_2$. It is also assumed that the distance between $G_1$ to A is much, much greater than that of A to 113. For both cylinders 117 and 118, the maximum positive and negative extension of the piston rod is set to $L_1$ and $L_2$ respectively by adjusting the length of the cable. The initial pretension force $F_1$ is given to both cables by adjusting the pressure of the air chamber. For both cylinders 117 and 118, the internal volumes of the cylinder chambers 119 and 120 are equal and have an equal pressure such that both cables 111 and 112 have identical pretension forces $F_1$.

When some external force $F_2$ is applied slowly to the vessel toward the $G_2$ direction, the vessel will be displaced as shown in FIG. 7*b*. When the center of the vessel C is moved by an amount $L_1$, the internal volume 119 of the cylinder 117 will be zero and the volume 120 of cylinder 118 will be doubled as shown in FIG. 7*b*. At this moment, the location of points A and B on cables 111 and 112 will be unchanged and also the tension force $F_1$ on both of the cables 111 and 112 will also remain the same. The total air volume of the compressed air system will also remain unchanged. This is because the air volume lost in chamber 119 is equal to the air volume gained in chamber 120.

When some additional force $F_3$ is applied as shown in FIG. 7*c*, then the point 113 cannot extend further and the additional force will cause elongation of the cable 111. As a consequence of this elongation the point A on cable 111 will move by an amount $\theta$ to the point A'. The center of the vessel will also move a distance $L_1+\theta$ as shown in FIG. 8*c*. The tension on cable 111 will be $F_1+F_3$ at this time and the cable will be lengthened by a distance of approximately $L_1+\theta$.

On the other hand, the tension on cable 112 will remain the same as the pretension force $F_1$ by the extension force provided by the compressed air in the cylinder 118. Since there is no change in the amounts of tension, the location of point B on the cable 112 will remain unchanged.

When the external force $F_3$ is removed slowly, the vessel will move back by a distance $\theta$ due solely to the force stored in the cable 111 in the form of elongation. The center position C will remain displaced from the original position by a distance $L_1$ as shown in FIG. 7*b*.

The sagging prevention system depicted in FIGS. 7*a*–7*c* includes the following properties:

(1) The sagging prevention system allows a low resistance vessel movement by distances $L_1$ in both directions.

(2) After displacement of the vessel by a distance $L_1$ from the preset center position, the moor which is subjected to the additional tension fully receives the additional tension while the moor at the opposite side of the vessel maintains its preset tension and thus prevents sagging.

(3) The mooring system effectively maintains its preset tension whenever the tension to a moor falls below the preset tension level.

It is important to point out that the present position of a piston in a cylinder (FIG. 7*a*) should fulfill the following relationship:

$$L_2 \geqq L_1+\beta \qquad (2)$$

where $\beta$ is the maximum elongation of a cable plus some additional safety measurement.

An example of a tension variation due to environmental force applied to a zero pretensioned mooring cable is depicted in FIG. 8*a*. Any negative tension in this figure represents sagging of a moor. In FIG. 8*b*, to prevent sagging a pretensioned level T is applied to the moor. This pretensioned mooring system would prevent sagging but requires a higher design work load level (W). A large portion of the strength of the cable is wasted for purposes of pretensioning.

A pretensioning system generally identical to that of FIG. 8*b* but also including an automated sagging preventer system is depicted in FIG. 8*c*. As can be seen in FIG. 8*c*, tension below the preset tension level T is prevented by the automated sagging preventer and tension force higher than T is maintained the same as in FIG. 8*b*. Since the automated sagging preventer prevents sagging, there is no reason to maintain a high pretension force level to prevent the sagging.

In FIG. 8*d*, the pretension force level is lowered from T to $T_1$. Consequently the design work load level can be lowered from W to $W_1$.

Some of the advantages of utilizing the automatic sagging preventer are:

(1) The automatic sagging preventer prevents sagging and enables lowering of the level of pretension force.

(2) The lower pretension level of the moor implies that a larger portion of the strength of the cable is utilized for mooring purposes rather than for purposes of pretensioning.

(3) The lower pretension force level also implies the presence of a lower design work load level. The beneficial result is a smaller diameter buoyant tube chain. The smaller diameter buoyant tube chain will be less affected by environmental forces such as developed by current, wind and wave action. The lower manufacturing and installation costs of a smaller diameter buoyant tube chain would enhance the competitive nature of the mooring system.

(4) By lowering the pretension force level, smaller capacity tensioning devices will be needed for pretensioning. These small capacity tensioning devices, also being of lower cost, thus further enhance the competitive nature of the mooring system of this invention.

(5) For a given mass, the resonant period of the transverse vibration of a cable is inversely proportional to the square root of the axial tension. Lowering the pretension force level makes the resonant period apart from the dominant wave period. This reduces the chance of possible problems of dynamic force amplification of the mooring system.

The fundamental principals and merits of the automated sagging preventer mooring system is explained utilizing FIGS. 6, 7 and 8. A more practical design of an automated sagging preventer system is presented in FIGS. 9*a* and 9*b*.

A typical semi-submersible drilling platform is depicted in FIG. 9*a*. An enlarged view of a column of the platform with an automated sagging preventer mooring system is depicted in FIG. 9*b*. In FIG. 9*b* reference 202 depicts a section of a buoyant tube chain mooring system while reference 203 depicts the chain link tube connecting devices of the moor. A link 204 is provided between the chain links 203 and multiple wire ropes 205. The reason for employing multiple wire ropes instead of a single large diameter wire rope is that the latter requires a very large diameter sheave to turn its direction. Smaller diameter wire ropes will change direction more readily and thus are more practical in real application as compared to single large diameter wire rope. The multiple wire ropes 205 are extended about multiple sheaves 206 and thus provide for angular change of force direction. A connector bridle 207 and connector links 208 are utilized to secure the multiple wire ropes 205 to a tension rod 209 which is an integral part of the automated sagging preventer system. The tension rod 209 provides docking (locking) between tensioning devices and the buoyant tube chain mooring lines. The tension rod also transfers tension from the mooring cable to the tensioning device and vice versa.

A stand 210 is provided for the tensioning devices for the automated sagging preventer which is securely welded, bolted or otherwise connected to the wall of the column of the semi-submersible vessel or other moored structure. A pair of compression type hydrapneumatic cylinders 211 and 212 are positioned in spaced relation onto the stand 210 and a coil spring 213 is interposed between them. The cylinders 210 and 211 are yieldable upon application of force in excess of a preset pretension force. A connection device embodying components 215 and 216 are provided to establish connection between the tension cylinders 211 and 212 and the compression spring 213 and the tension rod 209.

A pair of locking mechanisms 217 and 218 are mounted at the upper portion of the transverse connecting device 216. These locking mechanisms serve as a docking mechanism between the tension rods 209 and the tensioning devices. A guide stand 219 is provided for the tension rod 209 and is welded or otherwise secured to the wall structure of the column of the semi-submersible vessel. A pair of locking devices 220 and 221 are mounted on the guide stand 219 and function to provide a docking mechanism between the tension rod 209 and the guide stand.

A more detailed view of the automated sagging preventer system is depicted in FIGS. 10*a–d*. As can be seen in FIG. 10*a*, the tension rod 209 is guided by two guide stands 210 and 219 which are firmly welded to the wall structure of the column. Basically, the tension rod 209 is allowed to move freely in both the upward and downward directions if it is not locked by means of the various locking mechanisms. Various views of the tension rod 209 are depicted in FIGS. 10*a*, 10*b* and 10*c*. The tension rod is a simple steel rod provided with a pair of opposed teeth or gear strips fixed thereto or formed as a part thereof. These saw teeth or gear teeth are provided in order to establish a docking mechanism with locking devices. Further, the gear or saw teeth also prevent rotation of the tension rod 209. The tension rod 209 also functions as a guide for the spring guide 214 and as a rotation preventing guide for the connector mechanism 215.

An isometric view of the locking mechanism 220 is depicted in FIG. 10*d*. By extending the arm of a hydraulic jack portion 240 of the locking mechanism, the locking teeth 241 will be moved toward the tension rod 209 and will make docking contact with the saw or gear teeth of the tension rod. After the docking operation is completed, a safety pin 242 is inserted through mating holes to positively retain the locking mechanism in a semi-permanent docking position. Locking devices 217, 218, 220 and 221 may be of the same type and character and may be controlled by means of a central control unit that causes simultaneous activation of the hydraulic locking mechanisms. As can be seen in FIGS. 10*a* and 10*b*, when the system is completely installed the locking devices 220 and 221 are in an unlocked position with respect to the tension rod 209; but the locking devices 217 and 218 are in a locked position with respect to the tension rod. Thus, the tension rod 209 can be pushed up and down by controlling the pressure in the tensioning cylinders 211 and 212. In the same manner, the tension on the mooring cable 202 will be transferred to the tensioning device through the tension rod 209.

As shown in FIG. 10*b*, the distances $L_1$ and $L_2$ defined in equation (2) are clearly marked on the cylinder 211. When the tension rod 209 is urged downwardly by the external tension, then the transverse connector mechanism 216 will be urged downwardly. If the force exceeds the sum of the extension force of the two tensioning cylinders 211 and 212 then the sliding guide 215 will engage and force the spring guide member 214 downwardly against the compression spring 213. The downward movement of the tensioning devices or cylinders will be stopped when the bottom of guide member 214 makes contact with the top portion of the support stand 210. As can be seen in FIG. 10*b*, the distance $L_3$ must be equal to or smaller than distance $L_1$ in order to protect the cylinder. If elongation of the cable is ignored, then $L_3$ is the distance which governs the maximum movement of the moored vessel or structure. The stiffness or resistance force of the spring 213 and the maximum permitted displacement of the spring $L_3$ governs the softness of the entire mooring system.

It is expected that there will be some error in the measured length of the various mooring lines if the length of the mooring lines is very long. Thus, the automated sagging preventer system must have some flexibility in order to adjust the length of the mooring line to which it is connected. In addition, the connection of the mooring line with the automated sagging preventer should be of simple and reliable construction. The connection procedure of the mooring line and the automated sagging preventer is thus as follows:

In order to make the connection between the mooring line 202 and the end of the automated sagging preventer 203 as easy as possible, it is desirable to lower the tension rod 209 as much as possible. This is accomplished by the following procedure:

(a) The tension rod 209 is locked by means of the locking mechanisms 220 and 221 while the locking mechanisms 217 and 218 are unlocked. Then the connection mechanism 216 is elevated to its maximum extent by increasing the pressure of the tensioning devices 211 and 212. The locking mechanisms 217 and 218 are then activated to lock the tension rod 209 in assembly therewith. Then the locking mechanisms 220 and 221 are unlocked to thus unlock the tension rod 209 with respect to the guide stand structure 219 which is fixed to the column. The pressure of the tensioning devices is then reduced to atmospheric pressure. Because of the weight of the rod 209 the rod will move down until the bottom portion of the connector mechanism 216 rests on the top surface of the spring guide member 214.

(b) For each mooring line the procedure of (a) above is repeated until the tension rod 209 reaches the lowest possible position.

(c) For all mooring lines, a connection is then established between the buoyant tube chain by making a connection between the chain links 203 and the cable connector structure 204.

The procedure for providing a preset tension to all of the mooring lines of the mooring system is as follows:

(a) With the fixed locking mechanisms 220 and 221 in the unlocked position thereof and with the locking mechanisms 217 and 218 of the connection mechanism 216 in the locked position, the pressure within the tensioning devices 211 and 212 is increased for all of the moors in simultaneous manner. If the tensioning device of a moor is extended to its maximum elevation locking mechanism 220 and 221 are then locked with respect to the teeth of the tensioning rod 209 thereby enabling the stand structure 219 to support the tensioning rod. The locking mechanisms 217 and 218 are unlocked then depressurize cylinders 211 and 212 to atmospheric pressure. Because of the weight of the connection mechanism 216 the connection mechanism will move downwardly until the lower end of the guide portion 215 thereof engages the upper portion of the spring guide 214. The rod extension procedure is then repeated by closing the locking mechanisms 217 and 218, applying force to the connection mechanism 216 through energization of the tensioning mechanisms 211 and 212 and by releasing the locking mechanism 220 and 221 to permit upward movement of the tensioning rod.

(b) In the process of repeating the rod extending procedure, the length of the mooring lines will be shortened. At some stage, the tension of each mooring line will be equal to the predetermined tension value of tensioning devices 211 and 212. From this instance, the tensioning device will not induce further movement of the tensioning rod 209 because an equilibrium has been established. The equilibrium condition must happen to all of the mooring lines simultaneously. When such a condition of equilibrium has been established simultaneously in all of the mooring lines, the final setting of the automated sagging preventer can be accomplished.

The procedure for final setting of the automated sagging preventer is accomplished by first locking the locking mechanism 220 and 221 of all of the mooring lines simultaneously. Then locking mechanism 217 and 218 of all of the moors are simultaneously unlocked. The connector mechanisms 216 of all of the moors are then lowered until the lower end of the guide portion 215 thereof rests on the upper surface of the spring guide 214 thereof for each of the moors. Locking mechanisms 217 and 218 are then locked and a safety pin 242 is then positioned to ensure that the locking mechanisms remain in their locked position. Locking mechanisms 220 and 221 are then unlocked to thereby permit movement of the tensioning rods 209 of each of the moors. At this time the automatic sagging preventer is ready for operation and each of the moors is provided with identical pretension force by means of a cooperative adjustment that is provided by the automatic sagging preventers.

An example of the operation of the automatic sagging preventer mechanism of this invention is depicted in FIGS. 11*a*–11*c*. FIG. 11*b* shows the final presetting position of the connection mechanism 216. At this stage the $L_1$ and $L_2$ relationship shown in equation 2 must be fulfilled. FIG. 11*c* shows an extreme condition wherein the additional tension applied to the automatic sagging preventer exceeds the capacity of the compression spring 213. In this situation, any additional tension applied to the mooring line will be directly transferred to the support stand 210.

FIG. 11*a* shows the tension on the mooring line is less than the preset pretension that was automatically induced by means of the automatic sagging preventer. In this case, the automatic sagging preventer automatically acts to make the tension of the mooring line equal to the preset tension level by shortening the length of the mooring line to its maximum extent. Thus in real operation, the position of the tension rod 209 will be somewhere in between that illustrated in FIGS. 11*a*, 11*b* and 11*c*.

The compression spring 213 plays a very important role in the automatic sagging preventer system. The compression spring prevents impact when the guide portion 215 of the connector mechanism makes contact with the spring guide 214. It also functions essentially like the suspension system of an automobile and reduces the impact when external load is applied suddenly. When a compression spring is squeezed or shortened by application of compression force thereto, the restoring force stored in the compression spring will reposition the moored vessel or structure upon removal of the external force. The system depicted in FIGS. *7a–7c* does not have this position restoring capability because it lacks the provision of a compression spring.

The combined system of the automatic sagging preventer and the prepressurized buoyant tube chain will virtually eliminate the depth limitations of a mooring system of this nature. Thus the mooring system can be utilized for almost any type of vessel, floats or structures. Examples of the combined system installed to a slim and tall tower and a floating drilling and production platform are presented in FIGS. 12*a* and 12*b*.

The pretensioned catenary free mooring system of the present invention has effective application in connection with bottom supported platforms and towers as shown in FIG. 12*a*, semi-submersible drilling and service vessels as shown in FIG. 2, and submerged or substantially submerged floating platforms as shown in FIG. 12*b*. Referring now to FIG. 12*a*, a plurality of anchors 300 are provided at the sea bed 302, there being an anchor for each of the pretensioned buoyant tube type mooring chains that are employed for mooring of the platform tower 304. As shown, the platform tower is provided with a lower support structure 306 located at the sea bed. The support structure 306 may take any convenient form suitable for providing proper support for the tower structure. At the upper portion of the platform tower above the water surface S there is provided a working platform 308 on which may be supported a drilling rig 310, a helicopter pad 312, and any other suitable equipment for offshore drilling and servicing. The platform supporting tower 304 is provided in the case of deep water oil exploration, for example, where the distance from the water surface to the sea bed may be in the order of a few thousand feet or more. The upper 100 feet or so of the tower may extend above the surface of the water thereby providing ample distance between the water surface and the working platform for adequate protection of the equipment from the damaging effects of wave action even under severe storm conditions.

In view of the extended height of the tower above the sea bed, it will be appropriate to provide mooring support at several levels along the height thereof. For example, as shown in FIG. 12*a* the tower in 3000 feet water depth is moored at three levels, i.e., levels L1, L2 and L3. Mooring levels L1 and L2 are submerged as shown while mooring level L3 is located slightly above the level of the water surface. Mooring level L1 may be in the order of 1000 feet elevation above the sea bed while mooring level L2 may be in the order of 2000 feet above the sea bed. The particular mooring levels, however, may be selected for any other particular level, depending upon the design characteristics of the platform tower and its intended purpose.

As shown in FIG. 12*a*, each of the mooring chains 314 is in the form of a buoyant tube chain such as illustrated and described in connection with FIGS. 2–5. At the upper extremity of each of the tube chains is provided an automated sagging preventer, one of which being illustrated generally at 316 for the purpose of maintaining each of the tube chains under predetermined uniform pretensioning. It may be desirable to provide different pretensioning forces at each of the mooring levels L1, L2 and L3, depending upon the design characteristics involved. The purpose of the pretensioning mechanisms is multi-fold. The pretensioning mechanisms maintain each of the tube chains 314 under predetermined pretensioning to thereby provide recentering forces that oppose excursion inducing forces and thereby function to return the tower or vessel as the case may be to its properly oriented position above the sea bed. The buoyant tube chains also function to retard vibration or oscillation that may be induced to the tower or vessel by the activities that are being conducted at the service platform. The pretensioning mechanisms of the buoyant tube chains allow maintenance of each of the tube chains well within acceptable force limits regardless of the amount of lateral excursion that has occurred due to wave action, wind or other excursion inducing forces. The pretensioning mechanisms 316 are discussed in detail in connection with FIGS. 9*a*, 9*b* and 10*a–*10*d* hereinabove and 12. It should be borne in mind in connection with FIG. 12*a* that each of the buoyant tube chains is anchored at the sea bed. For the purpose of simplicity only, several of the buoyant tube chains are shown at each mooring level. The pictoral representation of FIG. 12*a* is therefore not intended to limit the invention in any manner whatever from the standpoint of numbers and orientation of mooring chains and pretensioning mechanisms.

Referring now to FIGS. 12*b* and 12*c*, a floating platform is shown generally at 318 which is adapted to be suspended above the level of the sea bed 320 with an upper portion 322 thereof extending above the surface S of the water. A working platform 324 may be positioned at the upper extremity of the upward projecting portion 322 and may be provided with appropriate equipment for the particular service activities that are to be conducted. The floating platform 318 may include an enlarged lower portion as shown at 326 for the purpose of providing storage capacity for produced petroleum products such as oil. A plurality of buoyant tube chains such as shown at 328 are employed to anchor the floating platform to a plurality of anchor devices or piles 330 that are provided at the sea bed 320.

In the enlarged view of FIG. 12*c* the semi-submersible floating base 318 is shown to be provided with a plurality of pretensioning mechanisms shown generally at 332 for providing mooring support and stability to thus enable the service activity accomplished under controlled conditions. Each of the pretensioning mechanisms 332 may be of similar construction as shown and described in connection with FIGS. 9*a*, 9*b* and 10*a–d*. As shown in FIG. 12*c* the pretensioning mechanisms 332 may be located at three different mooring levels, L1, L2 and L3, for similar purpose as shown and described in connection with FIG. 12*a*. The floating platform 318 is rendered buoyant in water to the extent that each of the buoyant tube chain mooring systems 328 is maintained under tension. The pretensioning mechanisms 332 maintains the tension of the tube chains above the minimum preset value and provide effective recentering forces in the event the floating platform is subjected to lateral excursion by the effects of wave action, current, wind, etc.

In view of the foregoing, it is evident that the present invention is one well adapted to attain all of the features hereinabove set forth together with other advantages which will become obvious and inherent from the description of the appratus itself. It will be understood that certain combinations and subcombinations are of utility and may be employed without reference to other features and subcombinations. This is contemplated within the spirit and scope of the present invention.

I claim:

1. A pretensioned catenary free mooring system for marine objects such as vessels and structures, comprising:

(a) a plurality of elongated substantially rigid tension members;

(b) connecting means securing said tension members in articulated end-to-end assembly and forming a mooring chain capable of withstanding predetermined forces in tension;

(c) said tension members and said connecting means being of predetermined weight and of a dimension displacing sufficient water to render the combined buoyancy thereof substantially neutral in water;

(d) said mooring chain adapted to be secured at one end to submerged anchor means and adapted to extend upwardly in angular substantially catenary free relation to the surface of the water and with the opposite end connected to a marine vessel or structure to be moored; and (e) tension control means maintaining said mooring chain under predetermined tension and permitting lateral movement of said marine vessels and structure due to forces induced by wind, wave action and current; said tension means comprising:

(1) elongated tension rod means of substantially rigid nature;

(2) connecting means securing said tension rod means to said buoyant tube chain;

(3) first lock means being secured to said vessel or marine structure and being movable between locked and unlocked positions in relation with said tension rod means;

(4) tranverse connector means being disposed in movable relation with said vessel or marine structure;

(5) second lock means being supported by said tension control means and being movable between selective locked and unlocked relation with said tension rod means;

(6) force transfer means being secured in fixed relation with said vessel;

(7) power actuator means being interposed between said force transfer means and said tranverse connector means and selectively extending and contracting to change the relative spacing thereof; and (8) said first and second lock means being actuated sequentially to permit locking of said tension rod means in relation to said vessel and to permit linear movement of said tension rod means by said transverse connector means for increasing and decreasing the tension applied through said connecting means to said mooring chain.

2. A catenary free mooring system as recited in claim 1, wherein said elongated tension members each comprise;

a hollow metal tubular member defining flotation chamber means therein.

3. A pretensioned catenary free mooring system as recited in claim 2, wherein:

said metal tubular member is of generally cylindrical form and has a wall thickness in particular ratio with the internal and external diameters thereof so as to render said tubular member and said connecting means substantially neutrally buoyant in water.

4. A pretensioned catenary free mooring system as recited in claim 2, wherein:

said flotation chamber means is of sealed nature and is filled with a gas.

5. A pretensioned catenary free mooring system as recited in claim 4, wherein:

gas transfer means is provided for said tension members, said gas within said flotation chamber being pressurized by introduction of gas through said gas transfer means to substantially counterbalance the hydrostatic pressure of water at the location depth of said tension members.

6. A pretensioned catenary free mooring system as recited in claim 2, wherein:

(a) said tubular member defines sealing surface means and thread means at each extremity thereof;

(b) said connecting means includes threaded caps forming closures at each extremity of said tubular member and establishing seals with said sealing surface means; and (c) connecting link means securing the end caps of adjacent tension members in tension restraining assembly.

7. A pretensioned catenary free mooring system as recited in claim 2, wherein:

gas transfer means communicates with said flotation chamber means and permits pressurization of said flotation chamber means in atmospheric conditions and in submerged conditions to substantially counterbalance hydrostatic pressure acting on the external surface area of said tension members at the particular location depth thereof.

8. A pretensioned catenary free mooring system as recited in claim 1, wherein said connecting means comprises:

(a) connecting eye means being provided at each extremity of each of said tension members; and (b) single connecting links between each of said tension members and defining loops means receiving said connecting eye means of adjacent tension members in secured relation therewith.

9. A pretensioned catenary free mooring system as recited in claim 1, wherein;

said tension rod means define lock engaging means along the length thereof, said lock engaging means selectively receiving said first and second locking means to lock said tension rod means in locked assembly therewith.

10. A pretensioned catenary free mooring system as recited in claim 9, wherein said lock engaging means is constituted by multiple evenly spaced ridges and grooves; and said first and second lock means each define ridges and grooves adapted for mating locking engagement with said ridges and grooves of said tension rod means.

11. A pretensioned catenary free mooring system as recited in claim 10, wherein said first and second lock means include fluid energized piston and cylinder means for moving said lock means to the lock and unlocked positions thereof.

12. A pretensioned catenary free mooring system as recited in claim 10, wherein each of said lock means comprises:

a pair of opposed locking mechanisms for locking engagement with opposed sides of said tension rod means, each of said locking mechanisms comprising:

(1) a hydraulic cylinder having a movable internal piston and a cylinder rod connected to said piston and extending from said cylinder;

(2) a locking element having said ridges and grooves thereon for mating locking engagement with the mating ridges and grooves of said tension rod means, said locking element being connected to said piston rod; and (3) means for mechanically locking said locking element against inadvertent movement while said locking element is in locked engagement with said tension rod means.

13. A pretensioned catenary free mooring system as recited in claim 1, wherein said power actuator means comprise:

fluid energized piston and cylinder assemblies having movable piston rods that control relative positioning of said force transfer means and transverse connector means.

14. A pretensioned catenary free mooring system as recited in claim 1, including:

resilient force transmitting means interposed between said force transfer means and tension rod means with said second lock means in engagement with said tension rod means and said first lock means in the unlocked position thereof, said resilient force transmitting means resisting excessive tension force applied to said tension rod means and permitting cushioned linear movement of said tension rod means.

15. A pretensioned catenary free mooring system as recited in claim 14, wherein:

said resilient force transmitting means is defined by compression spring means.

16. A pretensioned catenary free mooring system as recited in claim 1, wherein:

(a) said power actuator means is preset to apply pretensioning force of a preset force value to said tension rod means; and (b) said power actuator means is yieldable upon application thereto of a tension force exceeding said pretension force.

17. A pretensioned catenary free mooring system as recited in claim 1, wherein said connecting means comprises:

(a) sheave means rotatably supported by said marine object and defining a plurality of cable grooves;

(b) bridle means connected to said buoyant tube chain and said tension rod means; and (c) a plurality of cables interconnecting said bridle means and bending about said sheave means to accommodate angular deviation of said buoyant tube chain from said tension rod means.

* * * * *